US008790029B2

(12) United States Patent
Tsuchiya et al.

(10) Patent No.: US 8,790,029 B2
(45) Date of Patent: Jul. 29, 2014

(54) CUTTING APPARATUS AND IMAGE FORMING APPARATUS HAVING FIXED BLADE MODULE, MOVABLE MODULE AND DRIVE MODULE THAT ARE INDEPENDENTLY DETACHABLE

(75) Inventors: Masahiro Tsuchiya, Tokyo (JP); Yukihiro Mori, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 390 days.

(21) Appl. No.: 13/048,690

(22) Filed: Mar. 15, 2011

(65) Prior Publication Data

US 2011/0236117 A1 Sep. 29, 2011

(30) Foreign Application Priority Data

Mar. 25, 2010 (JP) ..... 2010-070826

(51) Int. Cl.
*B41J 11/66* (2006.01)
*B41J 11/70* (2006.01)
*B26D 1/08* (2006.01)

(52) U.S. Cl.
CPC *B41J 11/70* (2013.01); *B26D 1/085* (2013.01)
USPC ..... 400/621; 400/692; 358/304

(58) Field of Classification Search
CPC ..... B26D 1/085; B41J 11/70
USPC ..... 400/621, 621.1; 358/304; 347/157; 399/385–387
See application file for complete search history.

(56) References Cited

U.S. PATENT DOCUMENTS

| | | | | |
|---|---|---|---|---|
| 7,267,500 | B2 | 9/2007 | Tsuchiya et al. | |
| 7,857,534 | B2 * | 12/2010 | Watanabe et al. | 400/621 |
| 7,876,346 | B2 * | 1/2011 | Watanabe et al. | 347/222 |
| 2005/0281606 | A1 | 12/2005 | Koyama et al. | |
| 2007/0104527 | A1 * | 5/2007 | Watanabe et al. | 400/621 |
| 2009/0151582 | A1 | 6/2009 | Takabatake et al. | |
| 2010/0188470 | A1 * | 7/2010 | Tsuchiya et al. | 347/157 |

FOREIGN PATENT DOCUMENTS

| | | |
|---|---|---|
| JP | 2004-090255 | 3/2004 |
| JP | 2005-271204 | 10/2005 |
| JP | 2009-143100 | 7/2009 |

* cited by examiner

*Primary Examiner* — Daniel J Colilla
*Assistant Examiner* — Justin Olamit
(74) *Attorney, Agent, or Firm* — IPUSA, PLLC

(57) ABSTRACT

A cutting apparatus includes a fixed blade module including a fixed blade, a movable blade module including a movable blade that moves when the movable blade module is driven, and a drive module configured to drive the movable blade module. The fixed blade and the movable blade are configured to cut a recording medium. The fixed blade module, the movable blade module, and the drive module are detachably connected.

17 Claims, 15 Drawing Sheets

CUTTING APPARATUS AND IMAGE FORMING APPARATUS HAVING FIXED BLADE MODULE, MOVABLE MODULE AND DRIVE MODULE THAT ARE INDEPENDENTLY DETACHABLE

CROSS-REFERENCE TO RELATED APPLICATIONS

This application is based upon and claims the benefit of priority of the prior Japanese Patent Application No. 2010-070826, filed on Mar. 25, 2010, the entire contents of which are incorporated herein by reference.

BACKGROUND OF THE INVENTION

1. Field of the Invention

The present invention generally relates to cutting apparatuses and image forming apparatuses.

2. Description of the Related Art

A POS (Point-Of-Sales) terminal or a ticket issuing apparatus may include a compact thermal printer apparatus. The printer apparatus may include a cutting apparatus to automatically cut a continuous-feed paper or, a cutter to help manual cutting of the continuous-feed paper.

In the case of the printer apparatus including the cutting apparatus to automatically cut the continuous-feed paper, the cutting apparatus is mounted on a main body of the printer apparatus. The main body of the printer apparatus includes a thermal head, a platen, a motor, and the like. The cutting apparatus includes a movable blade mechanism having a fixed (or stationary) blade, a movable blade, and a motor or the like that moves the movable blade.

On the other hand, the cutter to help manual cutting of the continuous-feed paper includes a fixed blade that is mounted on the main body of the printer apparatus. The continuous-feed paper is cut by the fixed blade when the continuous-feed paper is pulsed in a predetermined direction relative to the fixed blade.

FIG. 1 is a perspective view illustrating an example of a conventional printer apparatus. A printer apparatus 100 illustrated in the right portion of FIG. 1 is formed by a combination of a printer unit 101 and a cutting apparatus 102 that are illustrated in the left portion of FIG. 1. The printer unit 101 includes a thermal head, for example. The cutting apparatus 102 includes a function of automatically cutting a continuous-feed paper. The printer unit 101 and the cutting apparatus 102 are integrally formed, that is, the two are fixed by screws or the like to form the printer apparatus 100. For this reason, the printer apparatus 100 including the cutter function becomes relatively bulky, and it becomes necessary to disassemble the inside of the printer apparatus 100 in order to simply replace a cutter blade of the cutting apparatus 102, for example. Alternatively, the entire cutting apparatus 102 would have to be replaced by a new cutting apparatus. In either case, it takes time and cost to replace the cutter blade or the entire cutting apparatus 102. As a result, the maintenance cost of the printer apparatus 100 including the cutter function is relatively high.

In another structure of the printer apparatus including the cutter function, a fixed blade and a cutter driving part to drive a movable blade are mounted on the main body of the printer apparatus that includes the thermal head, for example. The cutter driving part integrally includes a motor, a gear mechanism, and the like. In this case, it may be possible to reduce the size of the printer apparatus as a whole because the cutter driving part is mounted on the main body of the printer apparatus. However, it is difficult to replace only the cutter driving part, and the maintenance cost of the printer apparatus including the cutter function is relatively high.

Examples of image forming apparatuses including cutter functions are proposed in Japanese Laid-Open Patent Publications No. 2005-271204 and No. 2009-143100, for example.

SUMMARY OF THE INVENTION

Accordingly, it is a general object of the present invention to provide a novel and useful cutting apparatus and image forming apparatus, in which the problems described above are suppressed.

Another and more specific object in one embodiment of the present invention is to provide a cutting apparatus and an image forming apparatus, which may facilitate maintenance, such as replacement and repair, of parts related to a cutter function, in order to reduce both the time and cost of the maintenance.

According to one aspect in one embodiment of the present invention, there is provided a cutting apparatus including a fixed blade module including a fixed blade, a movable blade module including a movable blade that moves when the movable blade module is driven, and a drive module configured to drive the movable blade module, wherein the fixed blade and the movable blade are configured to cut a recording medium, and wherein the fixed blade module, the movable blade module, and the drive module are detachably connected to each other one relative to another.

According to another aspect in one embodiment of the present invention, there is provided an image forming apparatus including a printer module configured to print an image on a recording medium, a fixed blade module including a fixed blade, a movable blade module including a movable blade that moves when the movable blade module is driven, and a drive module configured to drive the movable blade module, wherein the fixed blade and the movable blade are configured to cut the recording medium, and wherein the printer module, the fixed blade module, the movable blade module, and the drive module are detachably connected to each other one relative to another.

Other objects and further features of the present invention will be apparent from the following detailed description when read in conjunction with the accompanying drawings.

DESCRIPTION OF THE PREFERRED EMBODIMENTS

Figure 1:
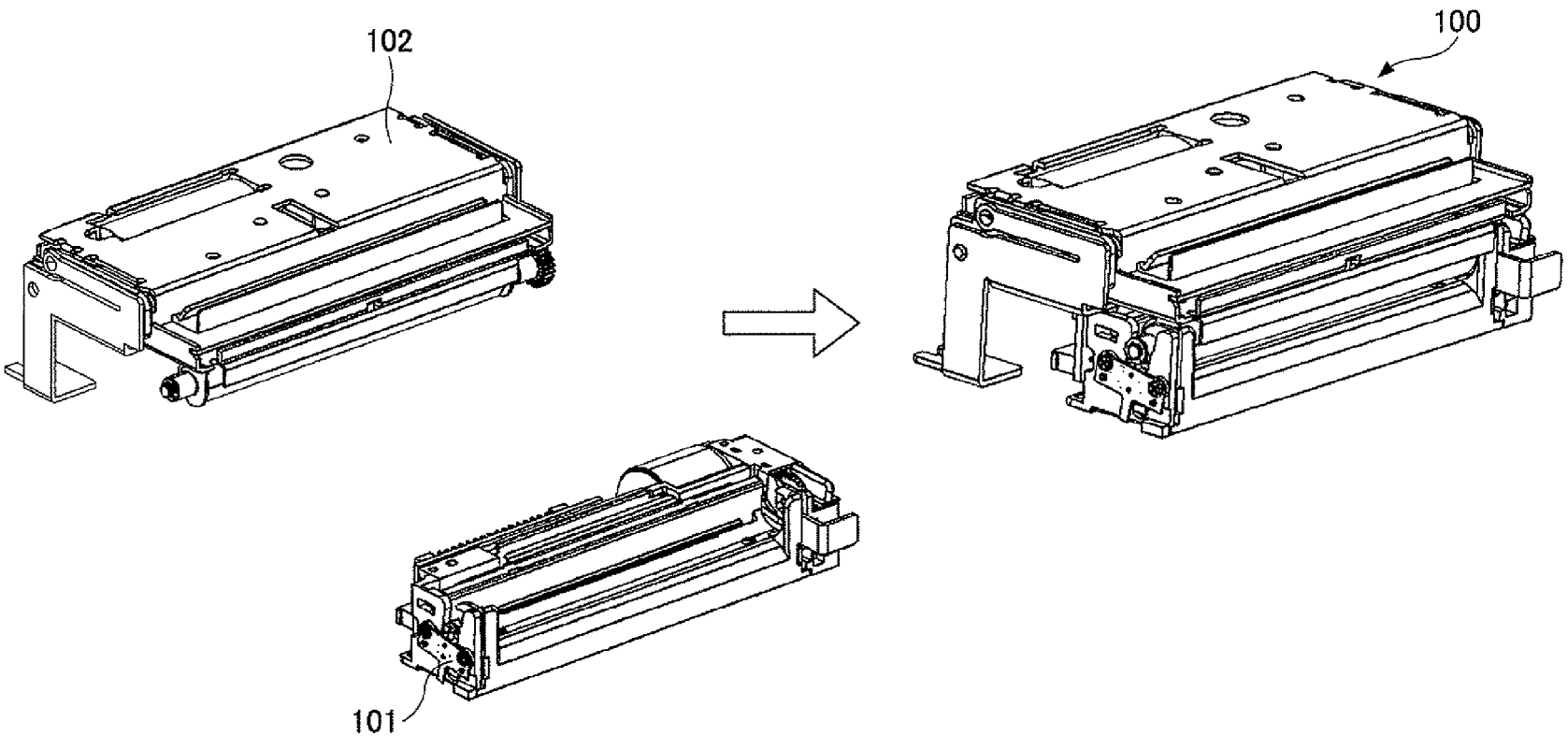
FIG.1 RELATED ART
FIG. 1 is a perspective view illustrating an example of a conventional printer apparatus.
Figure 2:
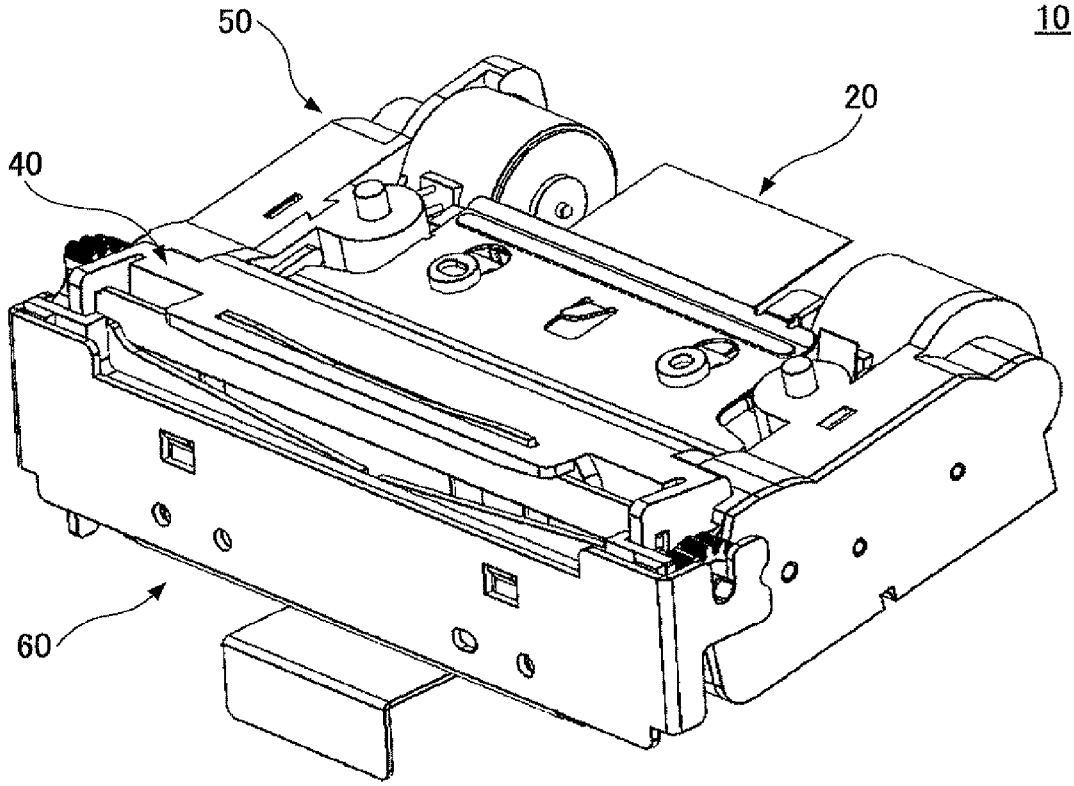
FIG. 2 is a perspective view illustrating a printer apparatus in a first embodiment of the present invention.

A description will be given of a cutting apparatus and an image forming apparatus in embodiments of the present invention, by referring to FIG. 2 and subsequent figures.

First Embodiment

Figure 3:
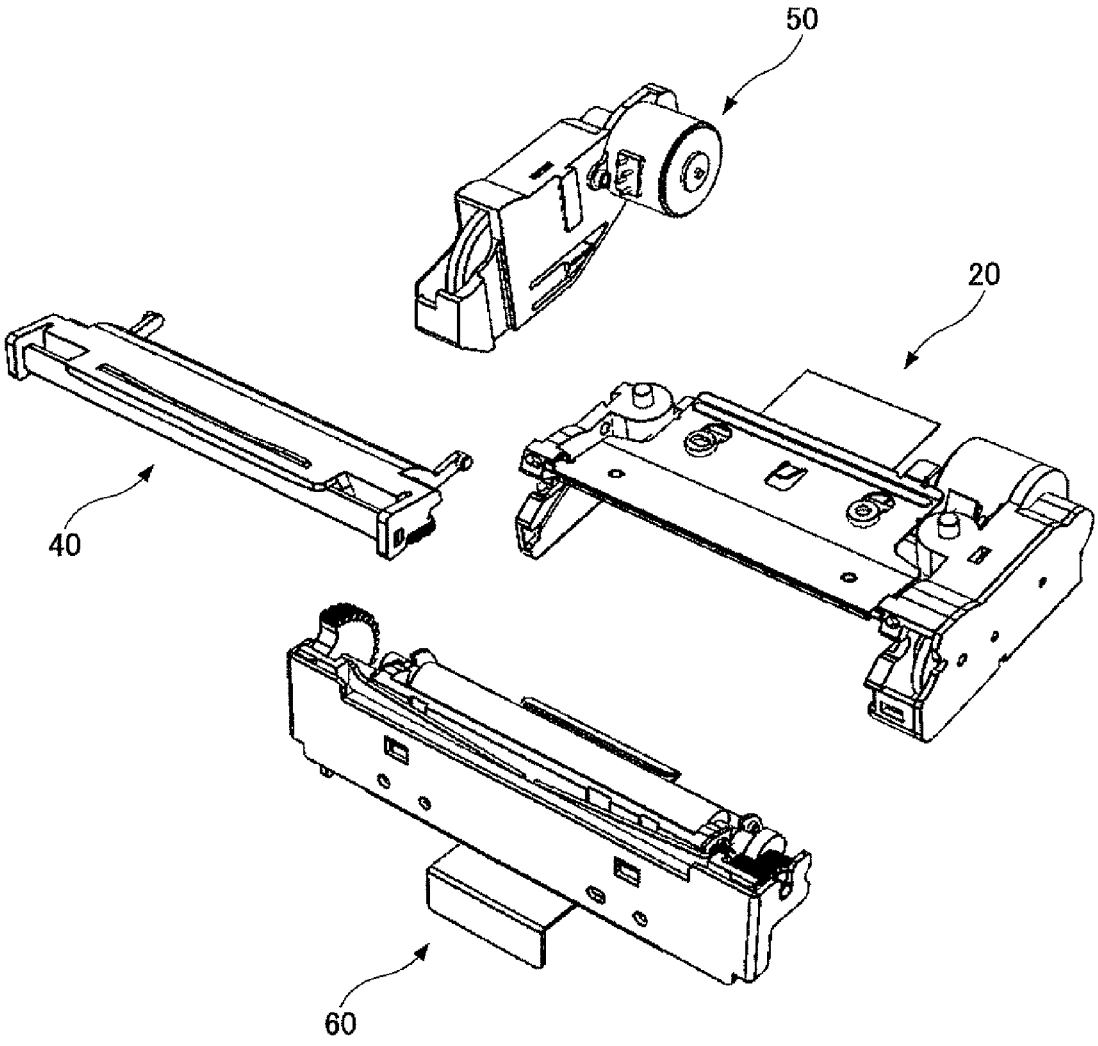
FIG. 3 is a disassembled perspective view illustrating modules of the printer apparatus in the first embodiment.

First, a description will be given of the image forming apparatus in a first embodiment of the present invention, by referring to FIGS. 2 and 3. FIG. 2 is a perspective view illustrating a printer apparatus in the first embodiment of the present invention, and FIG. 3 is a disassembled perspective view illustrating modules of the printer apparatus in the first embodiment.

In this embodiment, the present invention is applied to a printer apparatus. However, the present invention is of course not limited to the printer apparatus, and is similarly applicable to other image forming apparatuses, such as a copying apparatus, a facsimile apparatus, and a composite apparatus that include composite functions that may include a print function, a copy function, and a facsimile function. The composite apparatus is also sometimes referred to as a MFP (Multi-Function Peripheral).

A printer apparatus 10 includes a function of automatically cutting a recording medium, such as continuous-feed paper. As illustrated in FIGS. 2 and 3, the printer apparatus 10 in this embodiment includes a printer module 20, a fixed blade module 40, a drive module 50, and a movable blade module 60. The modules 20, 40, 50, and 60 are independent of each other, that is, these modules 20, 40, 50, and 60 may be separately assembled to and disassembled from the printer apparatus 10.

The printer module 20 includes a printer head which may be formed by a thermal head, for example, and includes a function to print images on the recording medium by a known recording (or printing) technique. The images printed on the recording medium are not limited to a particular image, and may include any arbitrary combination of pictures, photographs, characters, and the like. As will be described later in conjunction with a modification of the first embodiment, a printer apparatus, which includes a function to help manual cutting of the continuous-feed paper by a fixed blade, may be formed by combining the printer module 20 and the fixed blade module 40. Hence, the printer apparatus 10 of this embodiment which includes the function of automatically cutting the continuous-feed paper and the printer apparatus which includes the function to help manual cutting of the continuous-feed paper may share the printer module 20 and the fixed blade module 40.

Next, a description will be given of a method of assembling the printer apparatus in the first embodiment, by referring to FIGS. 4 through 21. FIGS. 4 through 21 are perspective views for explaining the method of assembling the printer apparatus in the first embodiment. As described above, the printer apparatus 10 in this embodiment may be formed by combining and connecting the printer module 20, the fixed blade module 40, the drive module 50, and the movable blade module 60.

Figure 4:
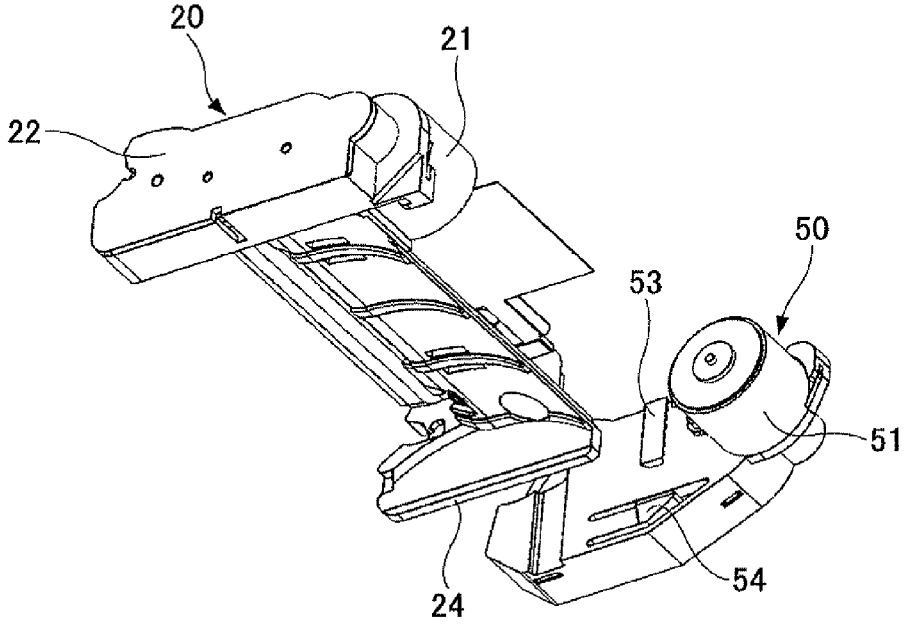
FIG. 4 is a perspective view for explaining a method of assembling the printer apparatus in the first embodiment.
Figure 5:
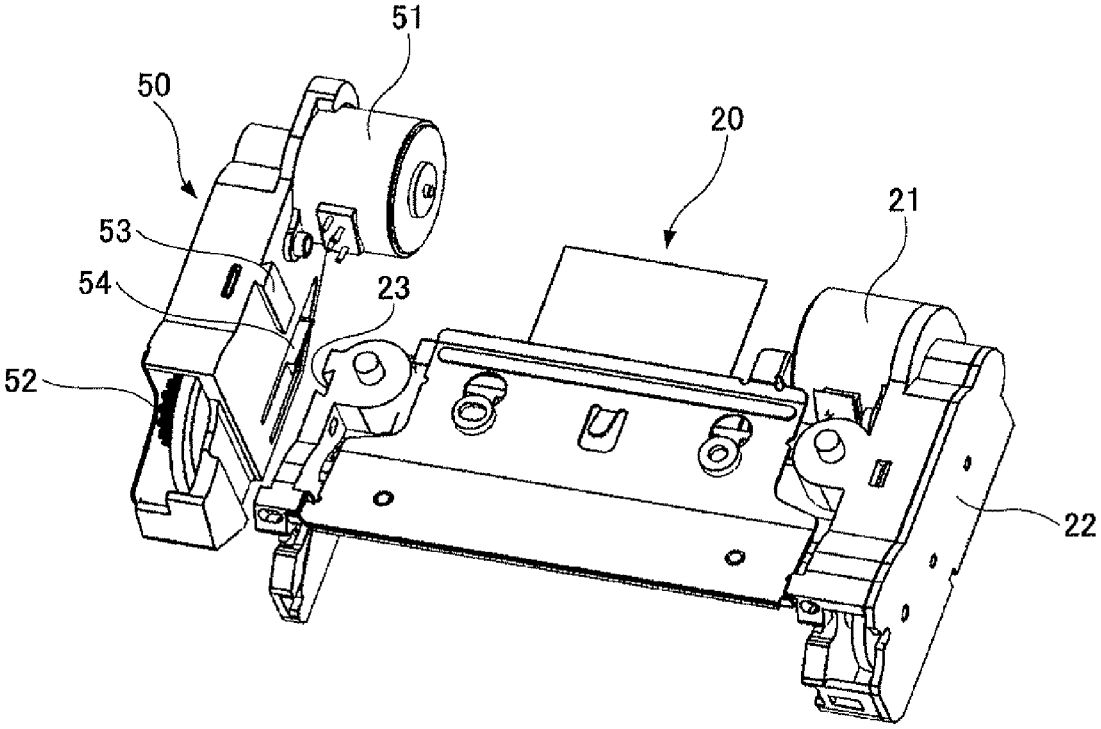
FIG. 5 is a perspective view for explaining the method of assembling the printer apparatus in the first embodiment.

First, the printer module 20 and the drive module 50 are connected, as illustrated in FIGS. 4 and 5. The printer module 20 includes a paper feed motor 21 to feed continuous-feed paper (not illustrated), and a gear mechanism (or gear part) 22 including at least one gear. The drive module 50 includes a motor 51 to drive a movable blade 61 which will be described later, and a gear mechanism (or gear part) 52 including at least one gear. The motor 21 and the gear mechanism 22 of the printer module 20 are provided on a side surface at one end of the printer module 20 along a predetermined direction perpendicular to a feed direction in which the continuous-feed paper is fed from a paper roll, for example. In other words, the predetermined direction is parallel to a direction (hereinafter also referred to as a width direction) in which a width of the continuous-feed paper is taken. The drive module 50 is connected to a side surface at the other end of the printer module 20 along the predetermined direction.

Figure 7:
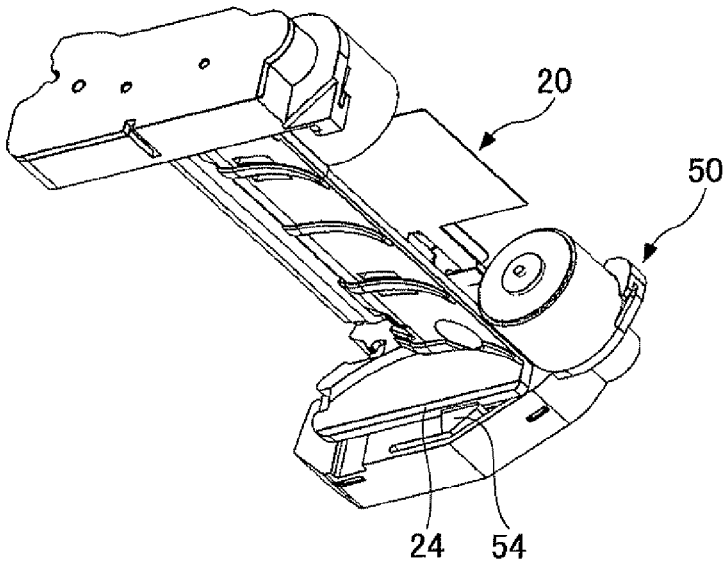
FIG. 7 is a perspective view for explaining the method of assembling the printer apparatus in the first embodiment.

A groove 23 having an inverted mesa shape (or inverted trapezoidal shape) is formed in the side surface of the printer module 20, and a rail 53 having an inverted mesa shape corresponding to that of the groove 23 is formed on the side surface of the drive module 50. The drive module 50 is arranged on top of the printer module 20, and the drive module 50 and the printer module 20 are caused to slide relative to each other by inserting the rail 53 into the groove 23, in order to connect the drive module 50 and the printer module 20. A spring-loaded stopper part (or lock part) 54 is provided on and is slidable along a direction perpendicular to the side surface of the printer module 20. In a state where the rail 53 is fully inserted into the groove 23 to a limit in a first sliding direction which is an upward direction in FIG. 4, for example, an engaging part 24 provided on the printer module 20 engages the stopper part 54 and is stopped by the stopper part 54 as illustrated in FIG. 7 in order to prevent the printer module 20 from disengaging from the drive module 50. When removing the printer module 20 and the drive module 50 from each other, the stopper part 54 is pushed into the side surface of the drive module 50 in order to permit extraction of the rail 53 from the groove 23 and allow the drive module 50 to slide in a second sliding direction which is a downward direction in FIG. 4, for example.

Figure 6:
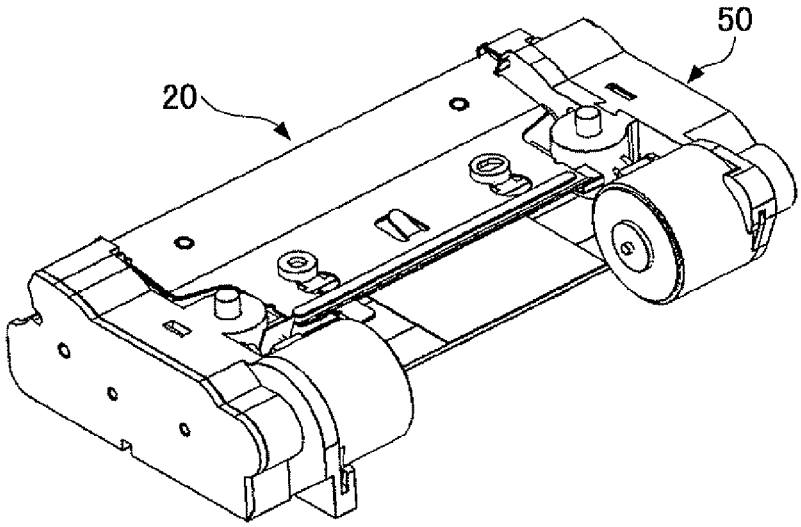
FIG. 6 is a perspective view for explaining the method of assembling the printer apparatus in the first embodiment.

Accordingly, the printer module 20 and the drive module 50 may be connected as illustrated in FIGS. 6 and 7 by sliding and fitting the printer module 20 and the drive module 50 relative to each other. In this state, the printer module 20 and the drive module 50 are connected by the engagement of the rail 53 that fits into the groove 23, and the stopper part 54 prevents the printer module 20 and the drive module 50 from disengaging from each other. The printer module 20 and the drive module 50 may not be removed from each other unless the stopper part 54 is pushed into the side surface of the drive module 50 in order to permit the printer module 20 to slide relative to the drive module 50. When the stopper part 54 is pushed into the side surface of the drive module 50, the printer module 20 and the drive module 50 may be removed from each other by sliding the printer module 20 and the drive module 50 relative to each other.

Next, a description will be given of a method of connecting the fixed blade module 40 to the combination of the printer module 20 and the drive module 50, by referring to FIGS. 8, 9, and 10.

Figure 8:
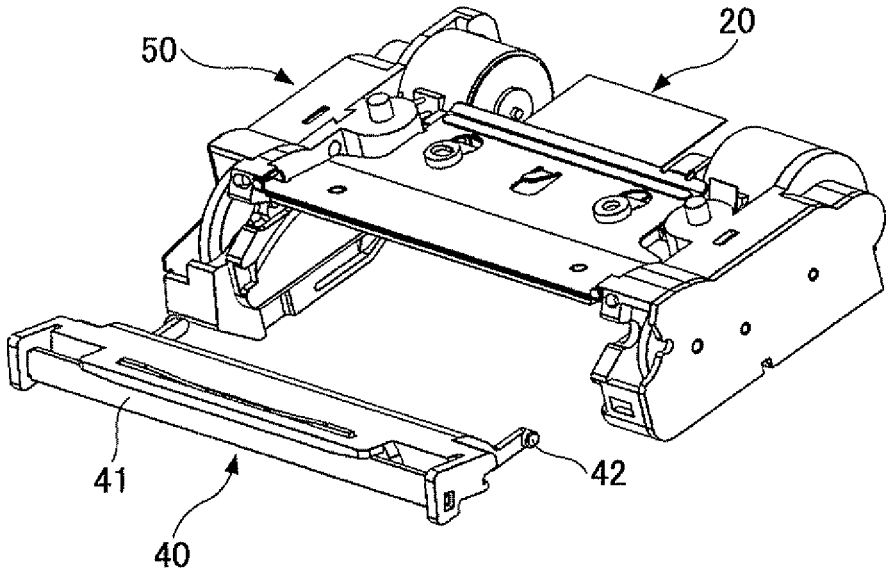
FIG. 8 is a perspective view for explaining the method of assembling the printer apparatus in the first embodiment.
Figure 9:
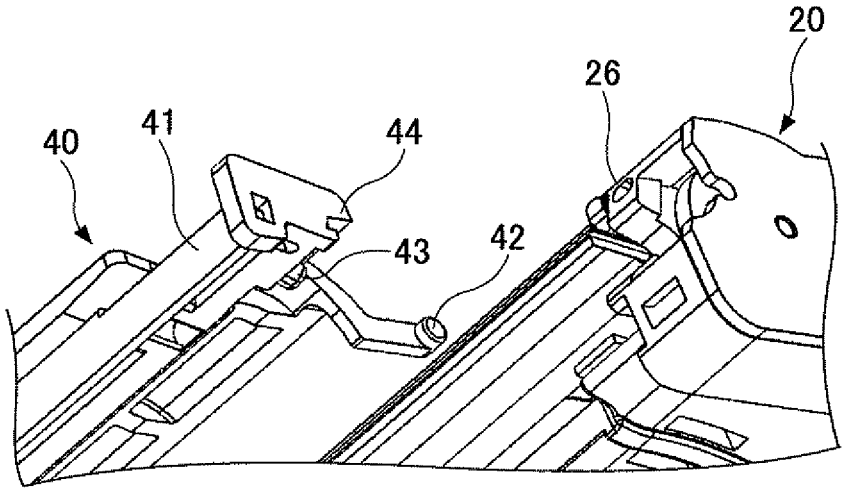
FIG. 9 is a perspective view for explaining the method of assembling the printer apparatus in the first embodiment.
Figure 10:
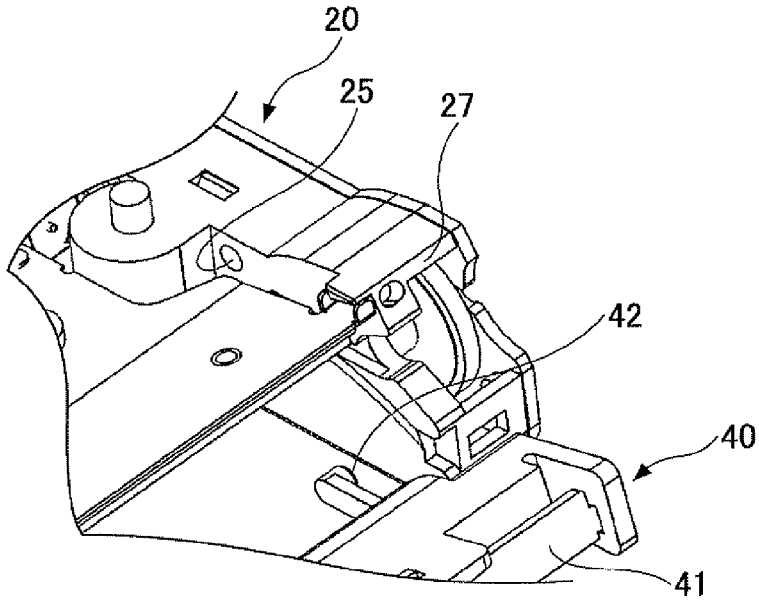
FIG. 10 is a perspective view for explaining the method of assembling the printer apparatus in the first embodiment.

The fixed blade module 40 includes a fixed blade (or stationary blade) 41, and a lock part 42, a positioning projection 43, and an engaging recess 44, as illustrated in FIGS. 8, 9, and 10. On the other hand, the printer module 20 includes a lock inserting part 25, a positioning projection inserting part (or positioning projection inserting hole) 26, and an engaging part 27, as illustrated in FIGS. 9 and 10.

When connecting the fixed blade module 40 to the printer module 20 in FIGS. 8, 9, and 10, the lock part 42 is inserted into the lock inserting part 25, the positioning projection 43 is inserted into the positioning projection inserting part 26, and the engaging recess 44 engages the engaging part 27. In other words, the fixed blade module 40 may be connected to the printer module 20 by sliding and fitting the fixed blade module 40 and the printer module 20 relative to each other. Further, the fixed blade module 40 and the printer module 20 may be removed from each other by sliding the fixed blade module 40 and the printer module 20 relative to each other.

Figure 11:
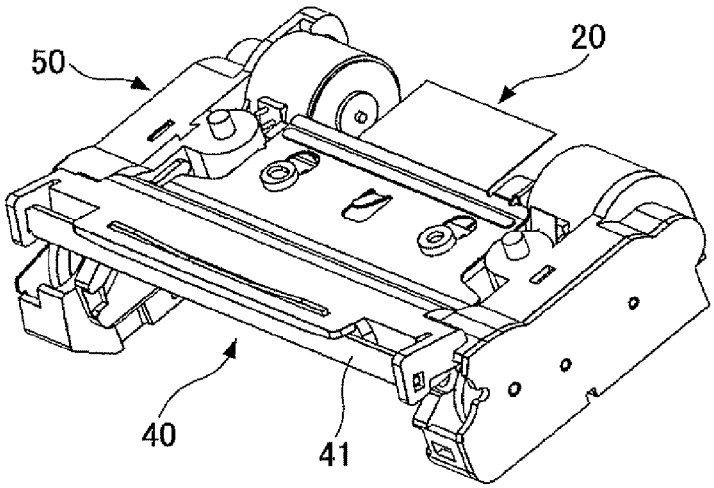
FIG. 11 is a perspective view for explaining the method of assembling the printer apparatus in the first embodiment.
Figure 12:
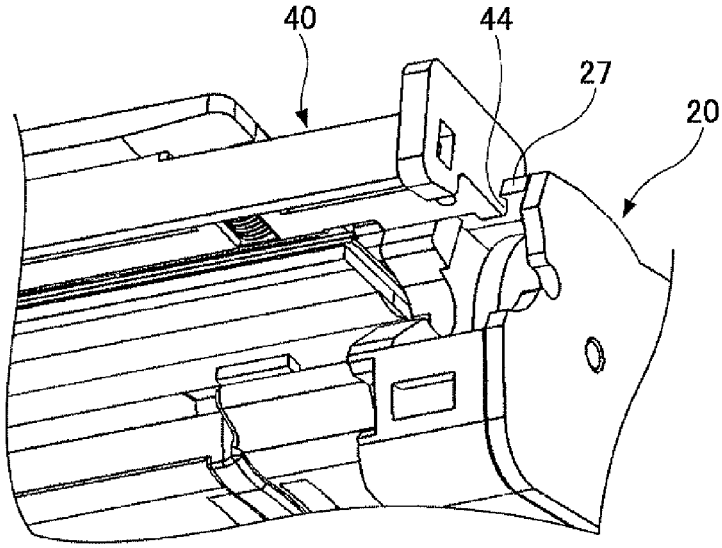
FIG. 12 is a perspective view for explaining the method of assembling the printer apparatus in the first embodiment.
Figure 13:
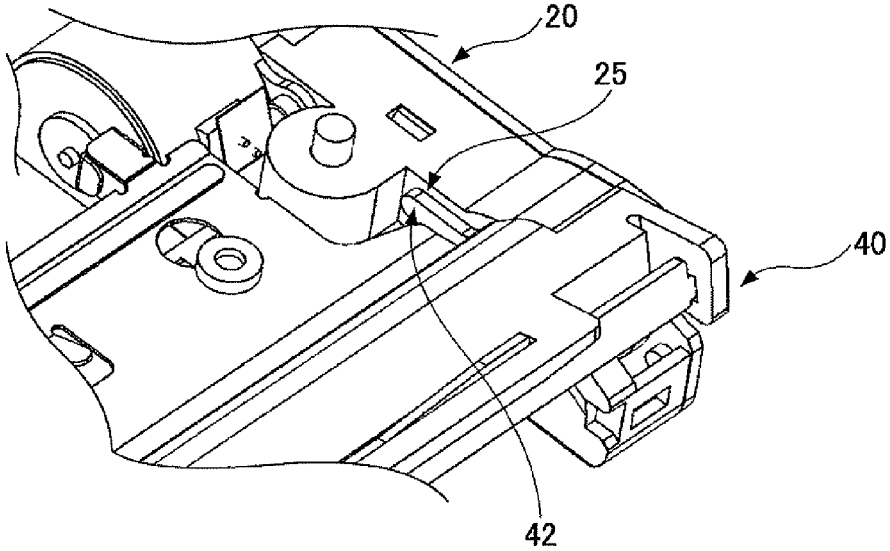
FIG. 13 is a perspective view for explaining the method of assembling the printer apparatus in the first embodiment.

A combination structure illustrated in FIG. 11 is obtained by connecting the fixed blade module 40 to the combination of the printer module 20 and the drive module 50. In the state where the fixed blade module 40 is connected to the printer module 20, the engaging part 27 of the printer module 20 engages the engaging recess 44 of the fixed blade module 40 as illustrated in FIG. 12, and the lock part 42 of the fixed blade module 40 is inserted into the lock inserting part 25 of the printer module 20 as illustrated in FIG. 13.

Next, a description will be given of a method of connecting the movable blade module 60 to the combination of the printer module 20, the drive module 50, and the fixed blade module 40, by referring to FIGS. 14 through 18.

Figure 14:
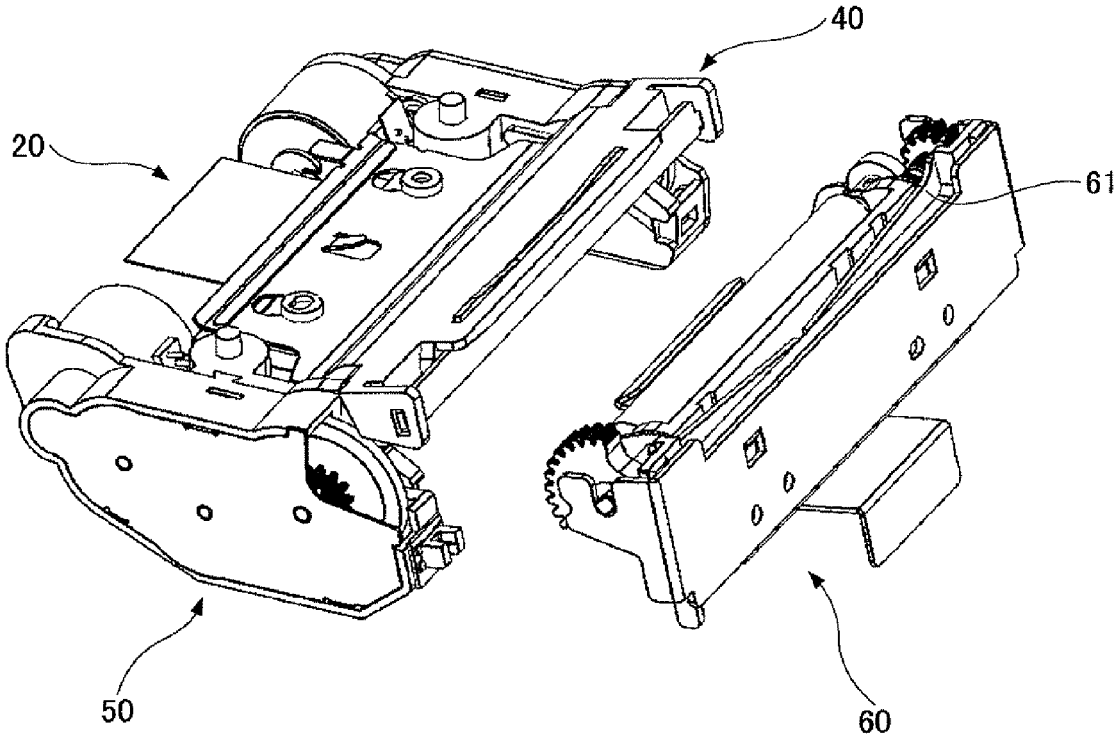
FIG. 14 is a perspective view for explaining the method of assembling the printer apparatus in the first embodiment.
Figure 15:
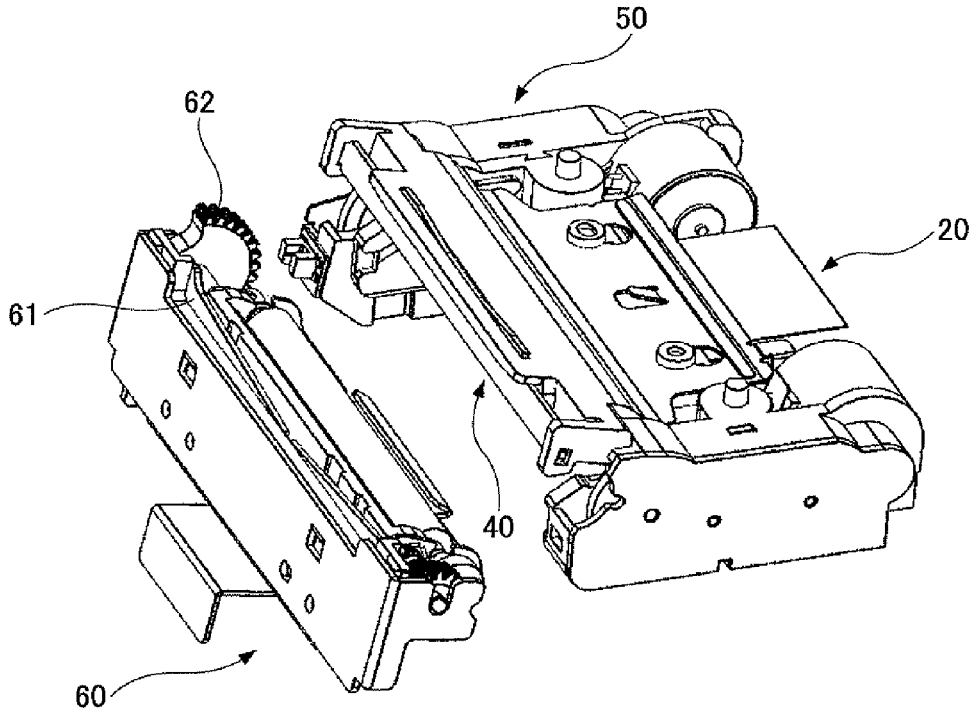
FIG. 15 is a perspective view for explaining the method of assembling the printer apparatus in the first embodiment.
Figure 16:
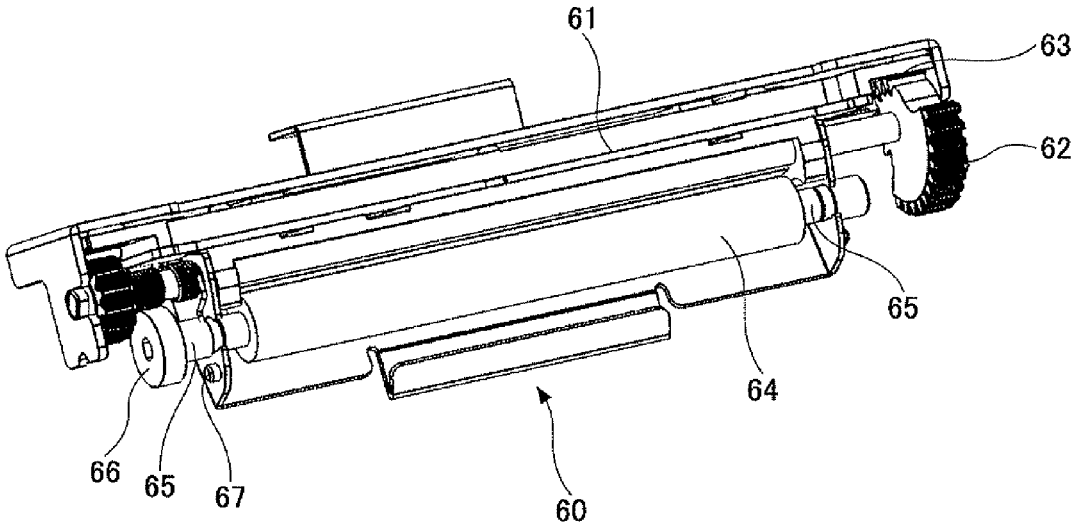
FIG. 16 is a perspective view for explaining the method of assembling the printer apparatus in the first embodiment.
Figure 17:
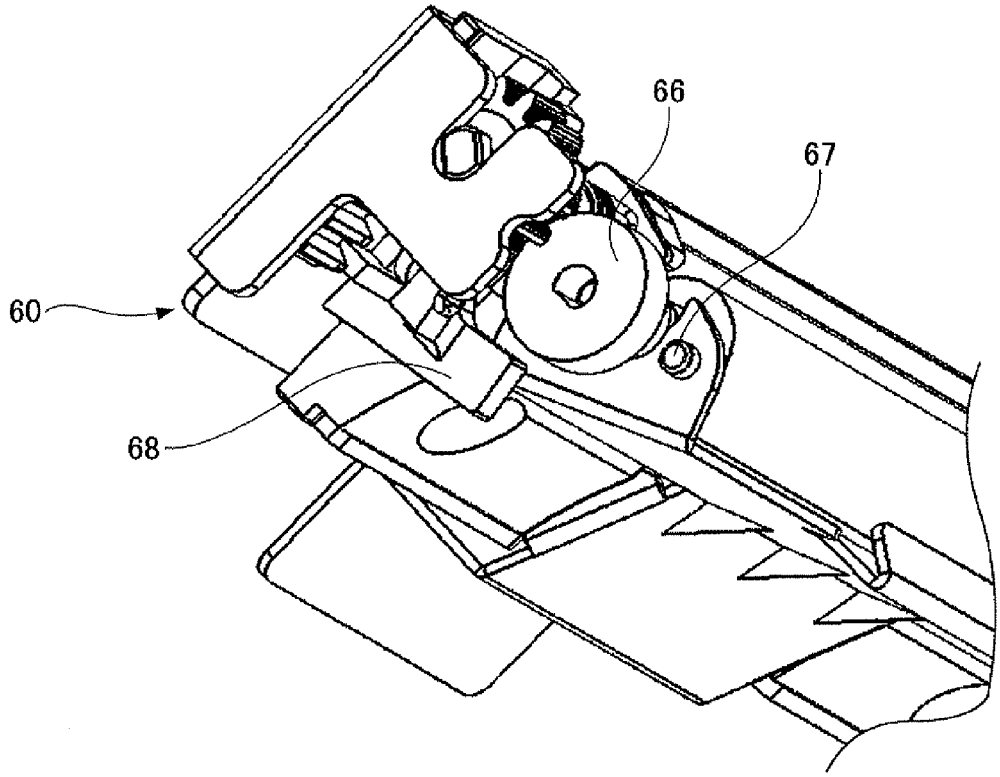
FIG. 17 is a perspective view for explaining the method of assembling the printer apparatus in the first embodiment.

The movable blade module 60 may be connected to the combination of the printer module 20, the drive module 50, and the fixed blade module 40, as illustrated in FIGS. 14 and 15. The movable blade module 60 includes the movable blade 61, a gear mechanism (or gear part) 62 including at least one gear to drive the movable blade 61, and a drive mechanism 63 including at least one gear, as illustrated in FIGS. 16 and 17. When the at least one gear of the gear mechanism 62 rotates, the at least one gear of the drive mechanism 63, which meshes with the at least one gear of the gear mechanism 62, is rotated in order to drive the movable blade 61 that is slidably provided. Hence, the movable blade 61 is moved when driven by the drive mechanism 63.

In addition, the movable blade module 60 further includes a platen roller 64 which rotates about a center axis thereof, a shaft part 65 concentrically provided with respect to the center axis of the platen roller 64, and a gear 66 connected to the shaft part 65. The movable blade module 60 also includes a bearing guide 67 and a stopper 68 illustrated in FIG. 17.

Figure 18:
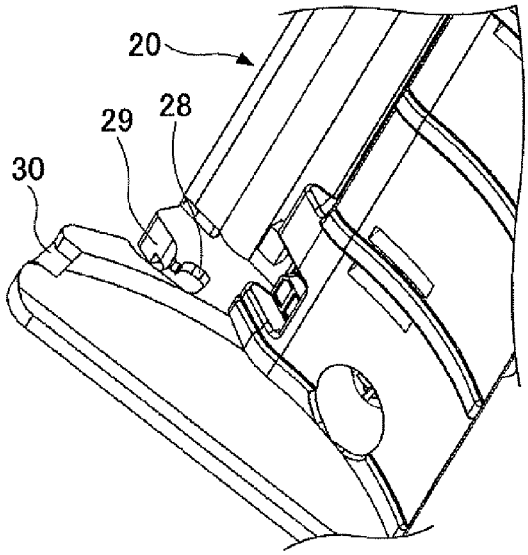
FIG. 18 is a perspective view for explaining the method of assembling the printer apparatus in the first embodiment.

On the other hand, the printer module 20 includes a bearing guide receiving part 28, a bearing part 29, and a stopper engaging part 30 illustrated in FIG. 18.

Figure 19:
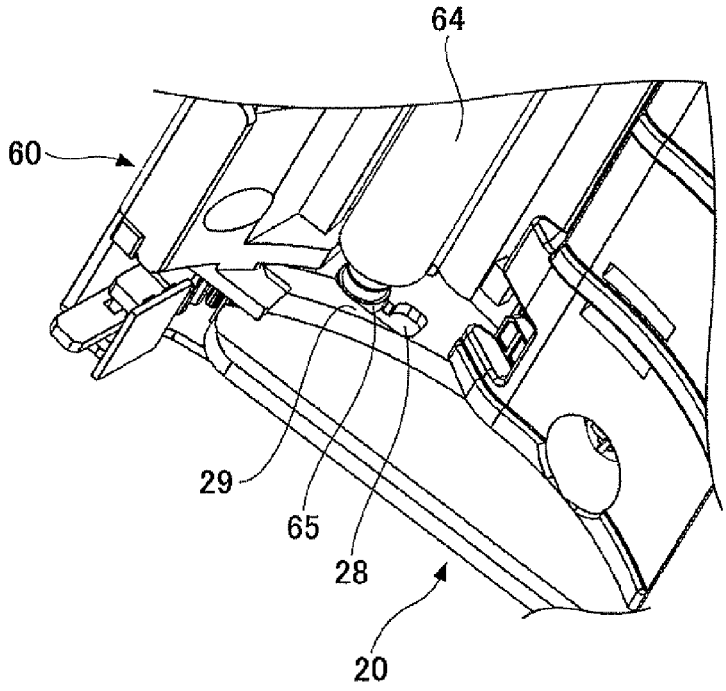
FIG. 19 is a perspective view for explaining the method of assembling the printer apparatus in the first embodiment.
Figure 20:
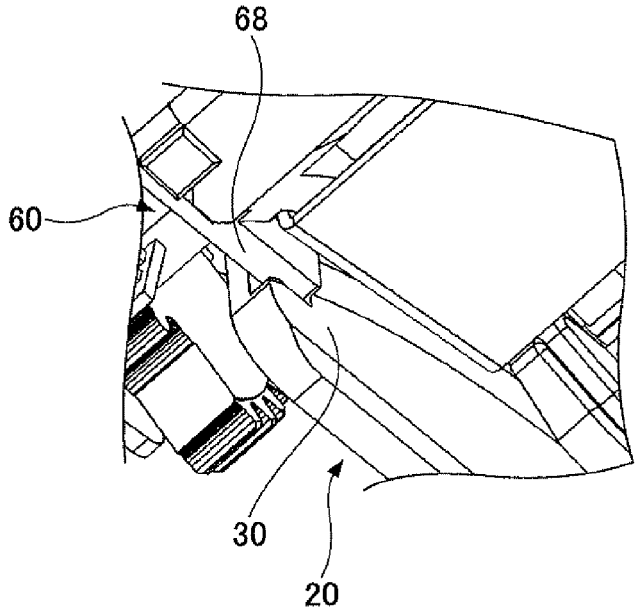
FIG. 20 is a perspective view for explaining the method of assembling the printer apparatus in the first embodiment.
Figure 21:
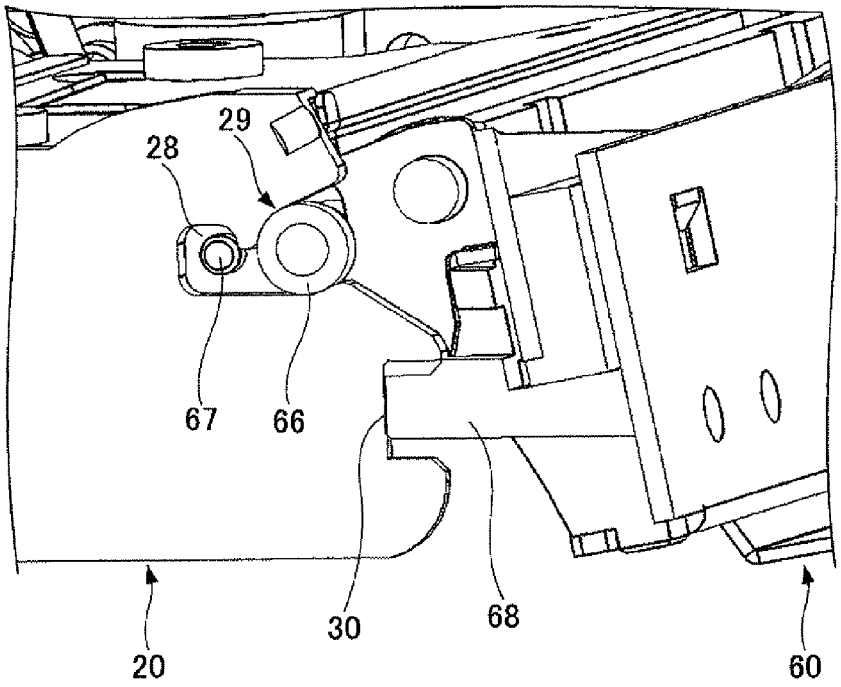
FIG. 21 is a perspective view for explaining the method of assembling the printer apparatus in the first embodiment.

As illustrated in FIGS. 19, 20, and 21, the movable blade module 60 is connected to the printer module 20 by inserting the bearing guide 67 into the bearing part 29, and fitting the bearing guide 67 into the bearing guide receiving part 28. As a result, the shaft part 65 of the movable blade module 60 is inserted into the bearing part 29, and the shaft part 65 is supported in a state rotatable within the bearing part 29. In this state, the gear 66 meshes with the at least one gear of the gear mechanism 22 illustrated in FIGS. 4 and 5. Hence, the gear 66 is rotated via the gear mechanism 22 when the motor 21 of the printer module 20 rotates in order to rotate the platen roller 64. In addition, in this state, the stopper 68 of the movable blade module 60 makes contact with the stopper engaging part 30 of the printer module 20 in order to prevent unwanted disengagement or disconnection between the movable blade module 60 and the printer module 20.

Hence, the movable blade module 60 may be connected to the printer module 20 by sliding and fitting the movable blade module 60 relative to the printer module 20 in the combination of the printer module 20, the drive module 50, and the fixed blade module 40. Similarly, the movable blade module 60 may be disconnected from the printer module 20 by sliding the movable blade module 60 relative to the printer module 20 in the combination of the printer module 20, the drive module 50, and the fixed blade module 40. Therefore, the printer apparatus 10 may be formed by a combination of the printer module 20, the drive module 50, the fixed blade module 40, and the movable blade module 60.

Figure 22:
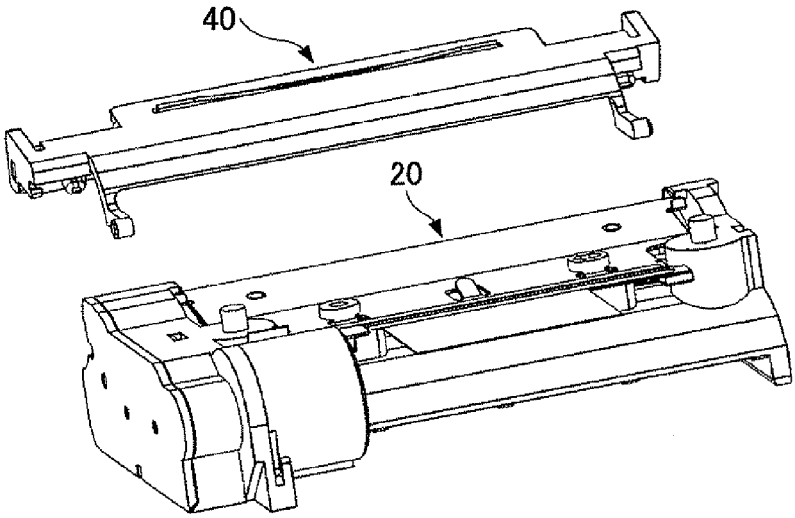
FIG. 22 is a perspective view for explaining a method of assembling the printer apparatus in a modification of the first embodiment.
Figure 23:
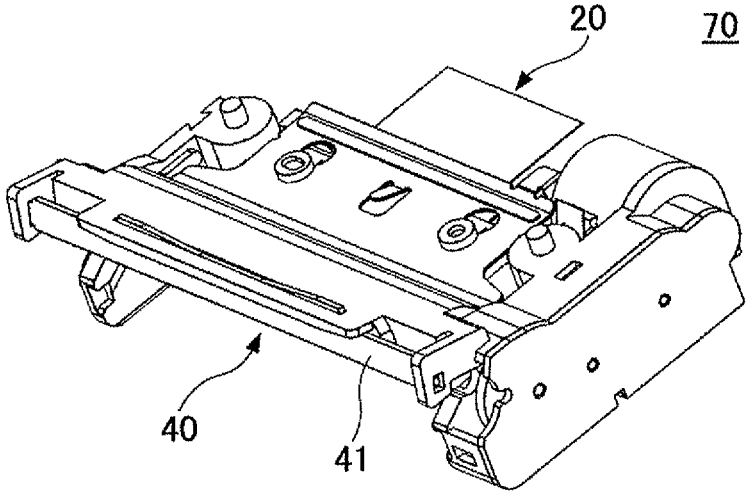
FIG. 23 is a perspective view for explaining the method of assembling the printer apparatus in the modification of the first embodiment.

In a modification of the first embodiment, the printer module 20 and the fixed blade module 40 may be connected (or attached) in the manner described above, as illustrated in FIG. 22, so that the printer module 20 and the fixed blade module 40 are disconnectable (or detachable) relative to each other. In this case, it is possible to form a printer apparatus 70, which includes a function to help manual cutting of the continuous-feed paper by the fixed blade 41, by the combination of the printer module 20 and the fixed blade module 40 as illustrated in FIG. 23. In this case, the fixed blade 41 of the fixed blade module 40 may be formed by a saw blade, for example.

Second Embodiment

Figure 24A:
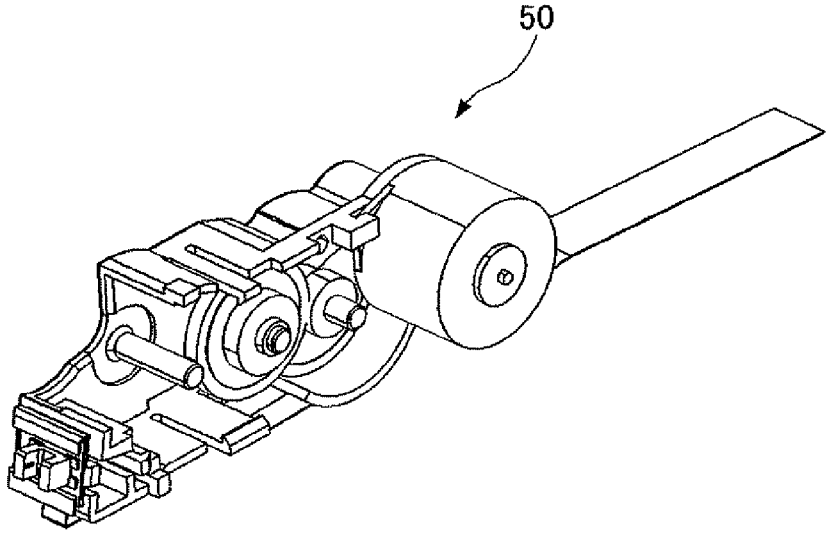
FIGS. 24A and 24B are perspective views for explaining the printer apparatus in a second embodiment of the present invention.
Figure 24B:
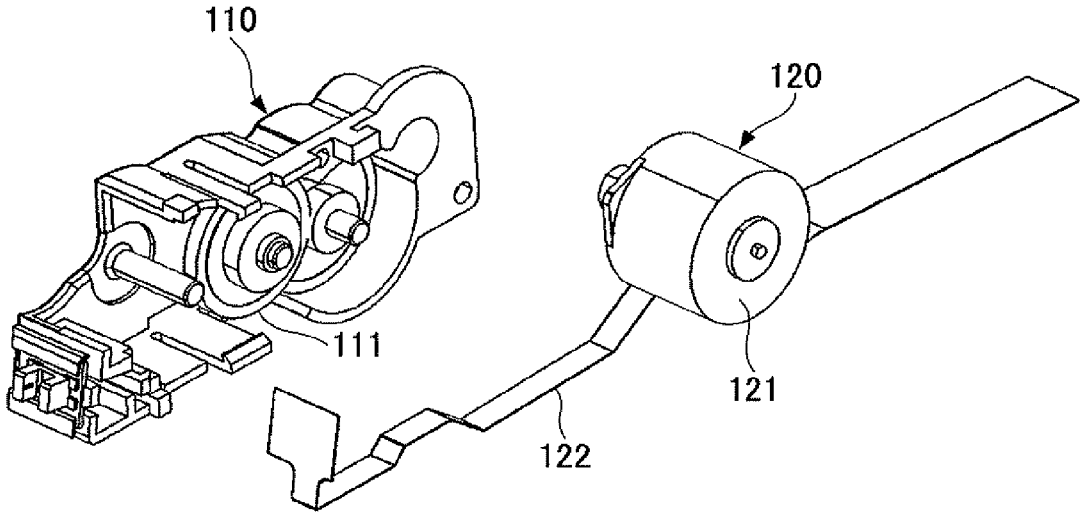

Next, a description will be given of the image forming apparatus in a second embodiment of the present invention, by referring to FIGS. 24A and 24B. In this embodiment, the drive module 50 includes a drive gear module 110 and a motor module 120 that are detachable from the drive module 50, as illustrated in FIG. 24B. FIG. 24A illustrates a state where the drive gear module 110 and the motor module 120 are connected to the drive module 50, and FIG. 24B illustrates a state where the drive gear module 110 and the motor module 120 are disconnected from the drive module 50. Other parts of the printer apparatus may be the same as those of the first embodiment or its modification described above.

By making the drive gear module 110 and the motor module 120 detachable relative to the drive module 50, it becomes possible to easily replace at least one of the drive gear module 110 and the motor module 120. Hence, the maintenance of the drive module 50 may be performed within a relatively short time at a relatively low cost.

In this example, the drive gear module 110 includes a gear unit 111 that is rotated by a motor 121 of the motor module 120 and transmits the motor rotation to the gear mechanism 62 (not illustrated in FIGS. 24A and 24B) in order to drive and move the movable blade 61. The motor 121 corresponds to the motor 51 of the first embodiment. The motor module 120 includes a wiring part 122 to supply power to the motor 121, in order to rotate the motor 121 and drive the movable blade 61.

Further, the present invention is not limited to these embodiments, but various variations and modifications may be made without departing from the scope of the present invention.

What is claimed is:

1. A cutting apparatus comprising:

a fixed blade module including a fixed blade;

a movable blade module including a movable blade that moves when the movable blade module is driven; and a drive module configured to drive the movable blade module, wherein the fixed blade and the movable blade are configured to cut a recording medium, wherein the fixed blade module, the movable blade module, and the drive module are detachable with respect to the cutting apparatus, wherein a first engaging part of the drive module and a second engaging part of a printer module of an image forming apparatus slide and fit with respect to each other in order to connect the drive module and the printer module, wherein one of the first engaging part and the second engaging part includes a rail, and a stopper part configured to prevent the drive module and the printer module from disengaging from each other, and wherein the other of the first engaging part and the second engaging part includes a groove configured to receive the rail.

2. The cutting apparatus as claimed in claim 1, wherein the drive module includes a motor module including a motor configured to drive the movable blade, and a drive gear module configured to transmit rotation of the motor to the movable blade module, and each of the motor module and the drive gear module is detachably connected to the drive module.

3. The cutting apparatus as claimed in claim 1, wherein the drive module includes a motor module including a motor configured to drive the movable blade, and a drive gear module configured to transmit rotation of the motor to the movable blade module, and the motor module and the drive gear module are detachably connected.

4. The cutting apparatus as claimed in claim 1, wherein the fixed blade and the movable blade cut the recording medium formed by continuous-feed paper.

5. The cutting apparatus as claimed in claim 1, wherein the movable blade module is detachably connected to a combination of the printer module, the fixed blade module and the drive module.

6. The cutting apparatus as claimed in claim 1, wherein a third engaging part of the fixed blade module and a fourth engaging part of the printer module slide and fit with respect to each other in order to connect the fixed blade module and the printer module, one of the third engaging part and the fourth engaging part includes a positioning projection, an engaging recess, and a lock part, and the other of the third engaging part and the fourth engaging part includes a positioning projection inserting part configured to receive the positioning projection, an engaging part configured to engage the engaging recess, and a lock inserting part configured to receive the lock part and prevent the fixed blade module and the printer module from disengaging from each other in a state in which the lock part is inserted into the lock inserting part.

7. The cutting apparatus as claimed in claim 1, wherein a fifth engaging part of the movable blade module and a sixth engaging part of the printer module slide and fit with respect to each other in order to connect the movable blade and the printer module, one of the fifth engaging part and the sixth engaging part includes a bearing guide, and a stopper, and the other of the fifth engaging part and the sixth engaging part includes a bearing guide receiving part configured to receive the bearing guide, and a stopper engaging part configured to make contact with the stopper and prevent the movable blade module and the printer module from disengaging from each other.

8. An image forming apparatus comprising:

a printer module configured to print an image on a recording medium;

a fixed blade module including a fixed blade;

a movable blade module including a movable blade that moves when the movable blade module is driven; and a drive module configured to drive the movable blade module, wherein the fixed blade and the movable blade are configured to cut the recording medium, and wherein the printer module and the drive module are detachably connected to each other and are detachable from the image forming apparatus, wherein the printer module and the fixed blade module are detachably connected to each other and are detachable from the image forming apparatus, wherein the printer module and the movable blade module are detachably connected to each other and detachable from the image forming apparatus, wherein a first engaging part of the drive module and a second engaging part of the printer module slide and fit with respect to each other in order to connect the drive module and the printer module, wherein one of the first engaging part and the second engaging part includes a rail, and a stopper part configured to prevent the drive module and the printer module from disengaging from each other, and wherein the other of the first engaging part and the second engaging part includes a groove configured to receive the rail.

9. The image forming apparatus as claimed in claim 8, wherein the drive module includes a motor module including a motor configured to drive the movable blade, and a drive gear module configured to transmit rotation of the motor to the movable blade module, and each of the motor module and the drive gear module is detachably connected to the drive module.

10. The image forming apparatus as claimed in claim 8, wherein the drive module includes a motor module including a motor configured to drive the movable blade, and a drive gear module configured to transmit rotation of the motor to the movable blade module, and each of the motor module and the drive gear module is detachably connected to the drive module.

11. The image forming apparatus as claimed in claim 8, wherein the fixed blade and the movable blade cut the recording medium formed by continuous-feed paper.

12. The image forming apparatus as claimed in claim 8, wherein the movable blade module includes a platen roller configured to feed continuous-feed paper which forms the recording medium.

13. The image forming apparatus as claimed in claim 12, wherein the printer module includes a paper feed motor configured to rotate the platen roller in order to feed the continuous-feed paper.

14. The image forming apparatus as claimed in claim 8, wherein the fixed blade module, the movable blade module, and the drive module form a cutting apparatus.

15. The image forming apparatus as claimed in claim 8, wherein the movable blade module is detachably connected to a combination of the printer module, the fixed blade module and the drive module.

16. The image forming apparatus as claimed in claim 8, wherein a third engaging part of the movable blade module and a fourth engaging part of the printer module slide and fit with respect to each other in order to connect the movable blade and the printer module, one of the third engaging part and the fourth engaging part includes a positioning projection, an engaging recess, and a lock part, and the other of the third engaging part and the fourth engaging part includes a positioning projection inserting part configured to receive the positioning projection, an engaging part configured to engage the engaging recess, and a lock inserting part configured to receive the lock part and prevent the fixed blade module and the printer module from disengaging from each other in a state in which the lock part is inserted into the lock inserting part.

17. The image forming apparatus as claimed in claim 8, wherein a fifth engaging part of the movable blade module and a sixth engaging part of the printer module slide and fit with respect to each other in order to connect the movable blade and the printer module, one of the fifth engaging part and the sixth engaging part includes a bearing guide, and a stopper, and the other of the fifth engaging part and the sixth engaging part includes a bearing guide receiving part configured to receive the bearing guide, and a stopper engaging part configured to make contact with the stopper and prevent the movable blade module and the printer module from disengaging from each other.

* * * * *

UNITED STATES PATENT AND TRADEMARK OFFICE

CERTIFICATE OF CORRECTION

PATENT NO. : 8,790,029 B2
APPLICATION NO. : 13/048690
DATED : July 29, 2014
INVENTOR(S) : Masahiro Tsuchiya and Yukihiro Mori It is certified that error appears in the above-identified patent and that said Letters Patent is hereby corrected as shown below:

On the Title Page, Item (54) and in the Specification, Column 1
the title to
"CUTTING APPARATUS AND IMAGE FORMING APPARATUS HAVING FIXED BLADE MODULE, MOVABLE BLADE MODULE AND DRIVE MODULE THAT ARE INDEPENDENTLY DETACHABLE"
from
"CUTTING APPARATUS AND IMAGE FORMING APPARATUS HAVING FIXED BLADE MODULE, MOVABLE MODULE AND DRIVE MODULE THAT ARE INDEPENDENTLY DETACHABLE"

Signed and Sealed this
Twenty-eighth Day of April, 2015

Michelle K. Lee

Michelle K. Lee
*Director of the United States Patent and Trademark Office*